US006406303B1

(12) United States Patent
Kosmala

(10) Patent No.: US 6,406,303 B1
(45) Date of Patent: Jun. 18, 2002

(54) COAXIAL-LIKE CONNECTOR

(75) Inventor: Michael Lawrence Kosmala, Mission Viejo, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/669,807

(22) Filed: Sep. 26, 2000

(51) Int. Cl.[7] ..... H01R 9/09
(52) U.S. Cl. ..... 439/63; 439/607
(58) Field of Search ..... 439/63, 675, 578, 439/607

(56) References Cited

U.S. PATENT DOCUMENTS 5,011,415 A * 4/1991 Suzuki et al. ..... 439/63
5,421,735 A * 6/1995 Dechelette ..... 439/101
6,164,977 A * 12/2000 Lester ..... 439/63

* cited by examiner

*Primary Examiner*—P. Austin Bradley
*Assistant Examiner*—Ann McCamey

(74) *Attorney, Agent, or Firm*—Roger C. Turner

(57) ABSTRACT

A coaxial type connector has largely rectangular cross-sections, with an outer contact width (E) that is much larger than its height (H). As a result, the impedance is lowest in primary sectors (140, 142) that extend between the inner contact (20) and top and bottom inside surfaces (136, 138) of the outer conductor, while the impedance is highest in secondary sectors (144, 146) that extend horizontally from the inner conductor to each side (132, 134) of the outer conductor. Applicant maintains a largely constant impedance at the primary sectors, while allowing changes in impedance at the secondary sectors as by cutouts (60, 160) in insulation at the secondary sectors for receiving retention tabs. As a result of the largely rectangular shape, the center contact can be formed of sheet metal of constant height (J) and of a width that can vary to provide enlargements (94, 96, 92) for retention and for mating at the front end of the connector, with minimal overall impedance change. Termination of the center conductor (100) of a coaxial cable to the rear termination end (98) of the inner contact can be accomplished while the inner contact lies within the rest of the connector, by providing joint-surrounding parts (200, 201, 210, 211) of the insulation and of the outer contact, that can lie out of the way until a crimp or solder joint is completed.

22 Claims, 7 Drawing Sheets

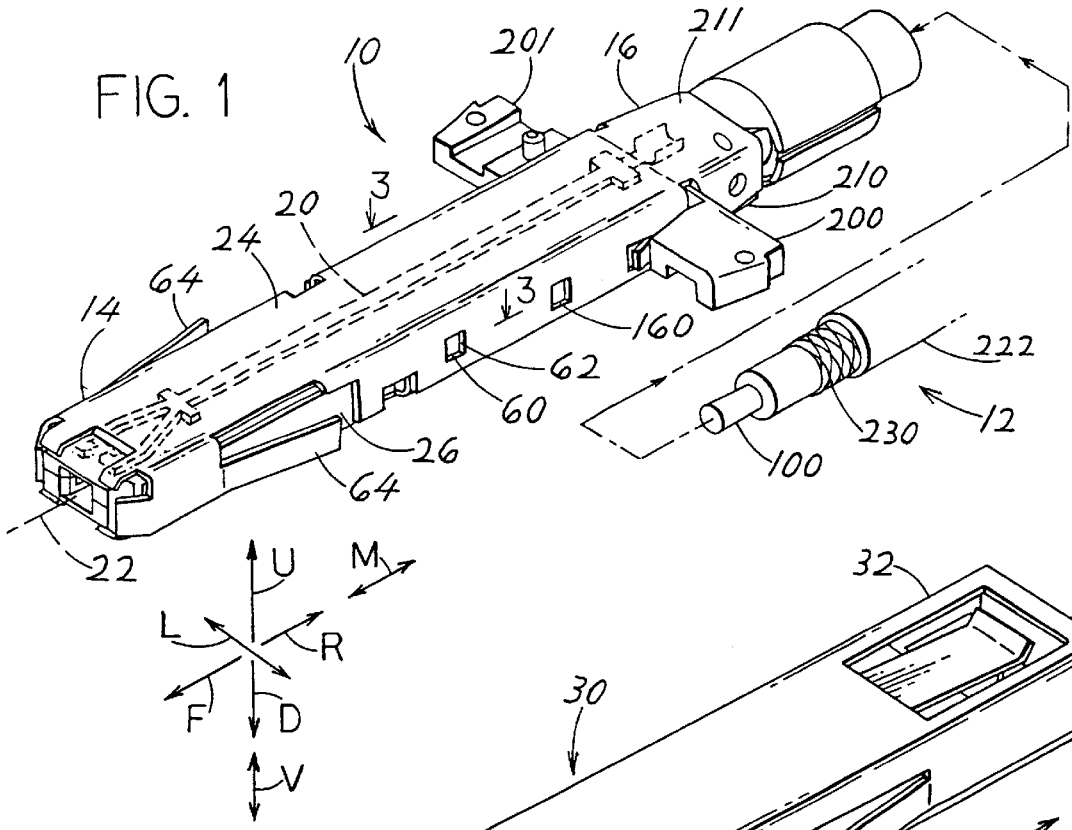
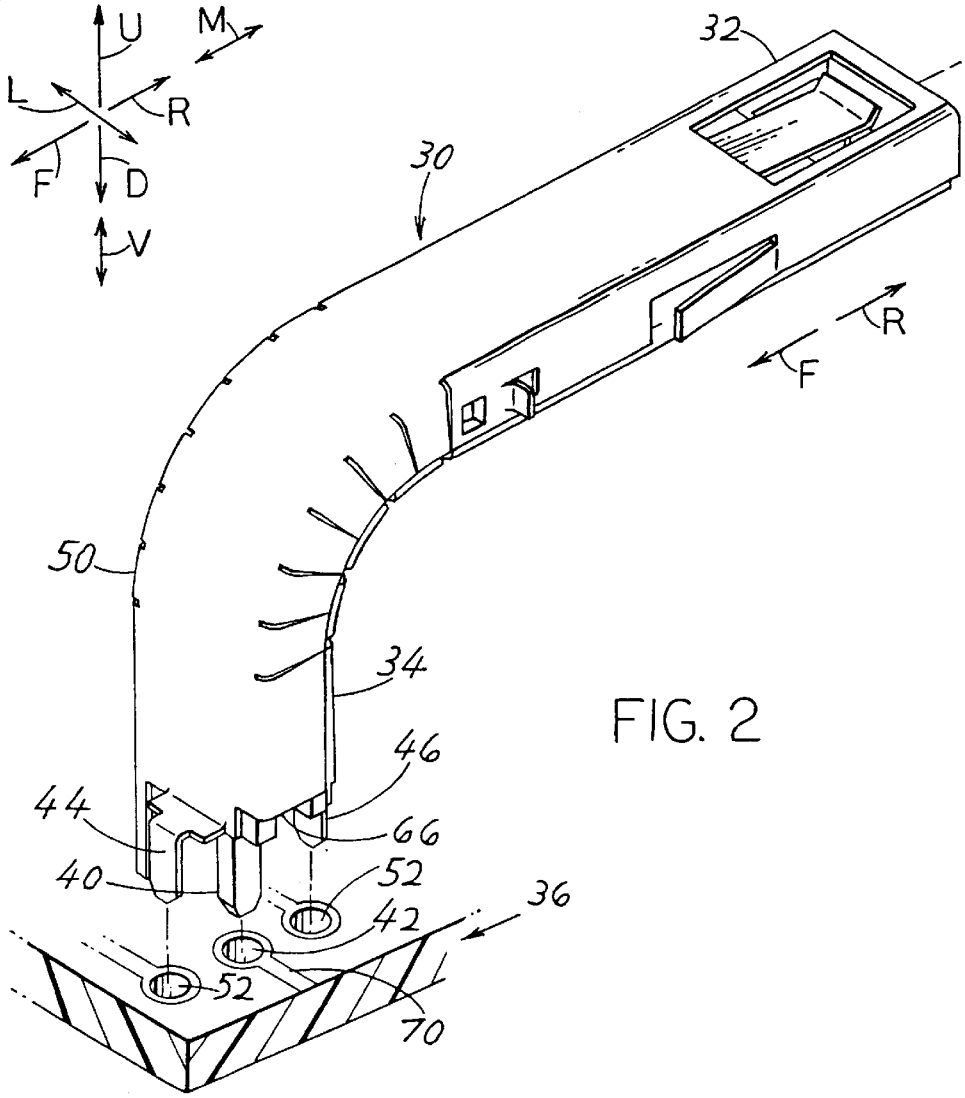
FIG. 2

211
210
V
22
20
40
30
104
105
110

224
220
4
12
228
M
15
15
98
100
200
14
14
201
96
10
120
A
80
24
60
20
13
13
26
94
92
12
12
14
90
82
104
102
40
30
4

FIG. 13
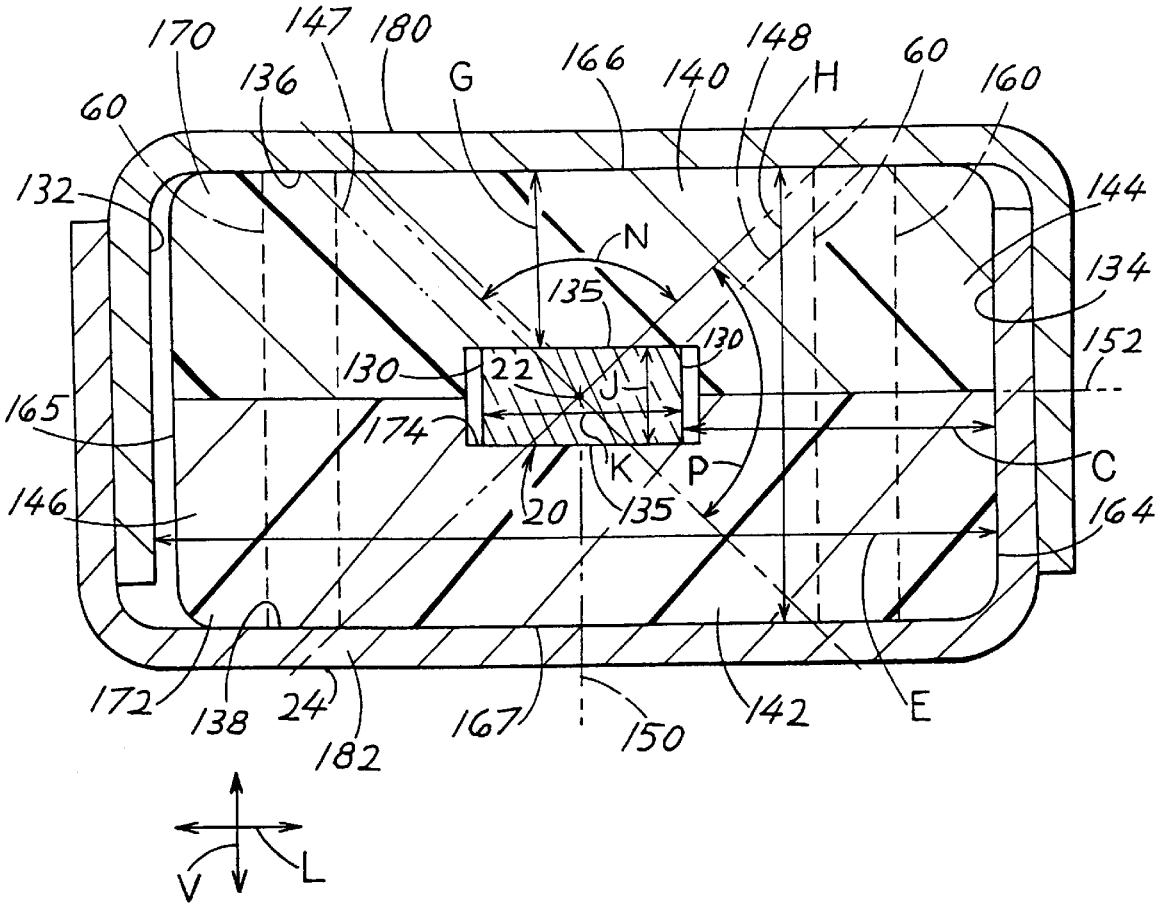
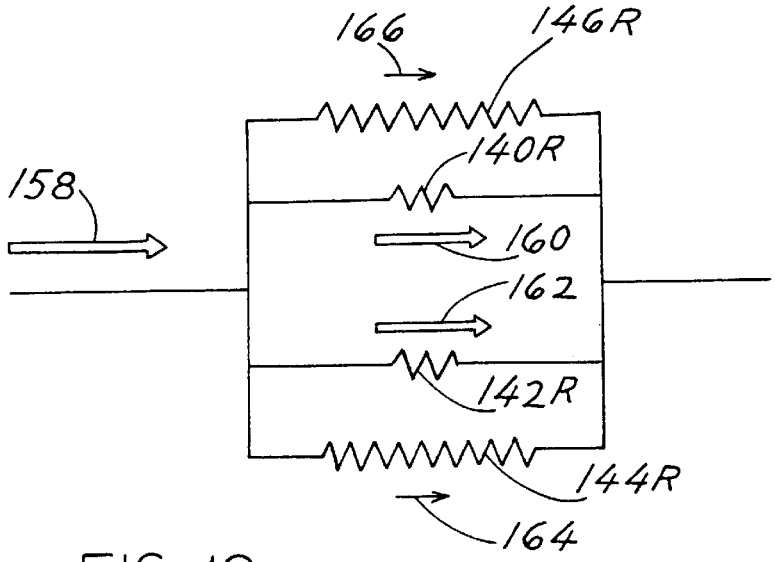
FIG. 16

FIG. 14
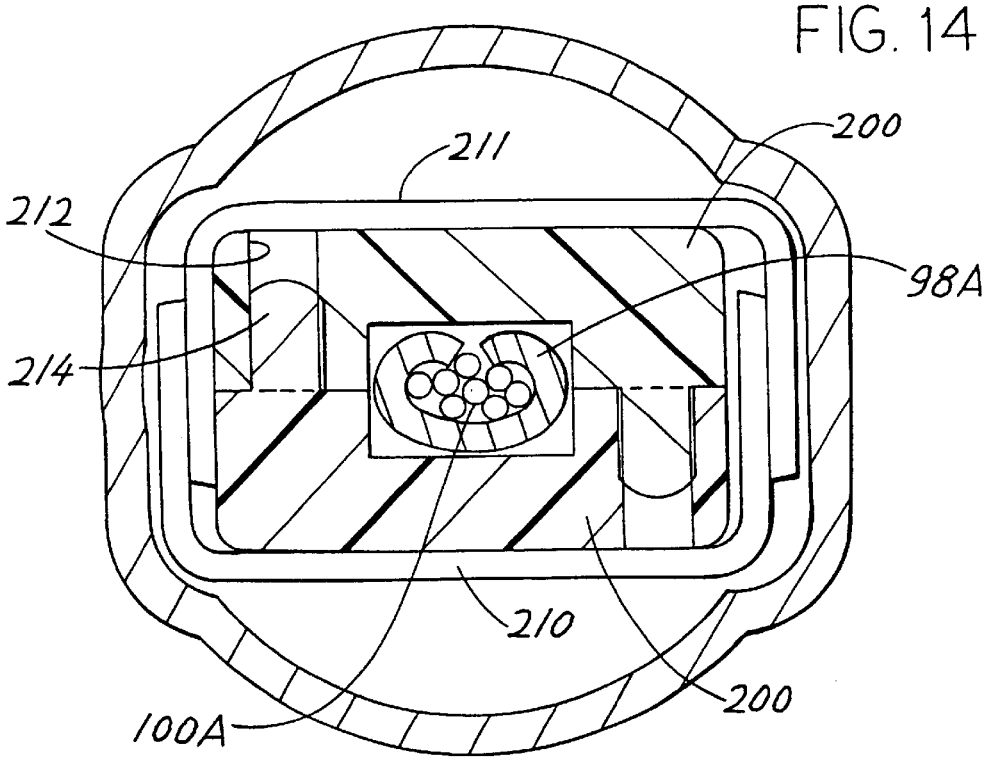
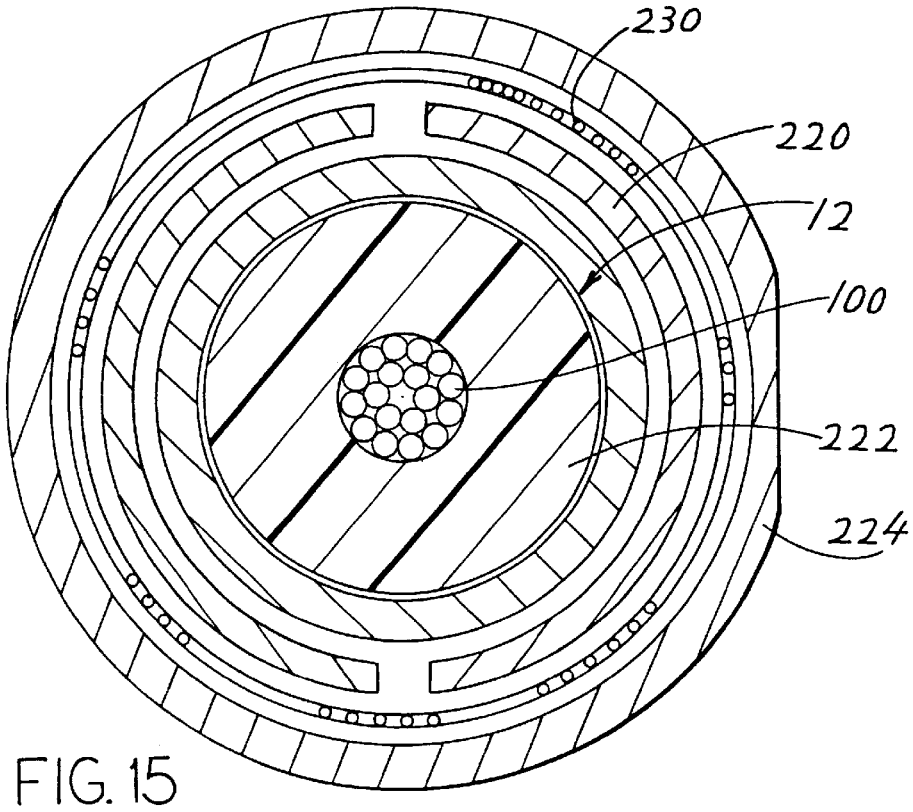
FIG. 15

COAXIAL-LIKE CONNECTOR

BACKGROUND OF THE INVENTION

Most coaxial-type connectors use a circular center contact, a hollow cylindrical outer contact, and a tubular insulation between them. The cylindrical shapes result in relatively expensive manufacturing methods such as machining of the inner contact to form cylindrical shapes. Also, retention features generally must be attached to the outside of the outer contact, since their insertion into slots in the insulation would result in a sudden change in impedance there, resulting in reflectance of signals and consequent increase VSWR (voltage standing wave ratio) and signal losses. Each coaxial type connector has a defined characteristic impedance with 50 ohms being the most common, and with losses increasing with deviations from the defined characteristic impedance at locations in the connector. A coaxial-type contact assembly, or connector, with inner and outer contacts separated by insulation, for carrying signals in the range of megahertz and gigahertz, which could be constructed at low cost and which enabled the provision of cutouts in selected areas of the insulation for retention features without seriously degrading the connector, would be of value.

SUMMARY OF THE INVENTION

In accordance with one embodiment of the present invention, a coaxial-type contact assembly, or connector, is provided which is designed for low cost construction and assembly and the inclusion of simple retention features. The connector includes an inner contact extending along the connector axis, an outer contact, and an insulation between them. Along a major region that extends at least one third of the length of the inner contact, the distance between the inner contact and a side surface of the outer contact is at least 140 percent of the distance between the inner contact and upper surface of the outer contact. This results in lowest impedance at primary sectors between the inner contact and the upper and lower surfaces of the outer contact, and much higher impedance at secondary sectors at the opposite sides of the inner contact. As a result, cutouts at opposite sides of the insulation, which lie substantially only in the secondary sectors, do not result in a large change in characteristic impedance that would result in a large increase in losses. The inner contact, like the outer one, can be formed of sheet metal with a constant thickness along most of its length, and with a width that can vary to provide retention features in the inner contact, for low cost construction.

In one connector, the outer contact is of rectangular cross-section with at least a 140% greater width than height. Also, the inner contact lies at the middle of the cross-section so it is equally spaced from the top and bottom of the outer contact. In that case, primary sectors lie above and below the inner contact and secondary sectors lie on opposite sides. The outer contact can have a variety of shapes, so long as there are primary and secondary sectors of distinctly different impedances (e.g. with the distance between contacts at least 40% greater at the secondary sector(s) than at the primary sector(s), with the impedance along the length of the primary sector or sectors being substantially constant.

Termination of the rear termination end of the inner contact to the center conductor of a coaxial cable, can be accomplished while the inner contact lies locked in the rest of the connector, by allowing the outer contact and the insulation to have parts that can be shifted away from positions that closely surround the rear end of the inner contact. After joining as by crimping a tubular portion of the inner contact around the cable center conductor, parts of the insulation and outer contact can be moved to positions closely around the rear end of the inner contact. The insulation can be formed as two identical members with rear ends each forming a joint-surrounding part connected by a band to the rest of the insulation member, with the band molded integrally with the main part and joint-surrounding part of the insulation.

The novel features of the invention are set forth with particularity in the appended claims. The invention will be best understood from the following description when read in conjunction with the accompanying drawings.

BRIEF DESCRIPTION OF THE DRAWINGS

FIG. 1 is a front and top isometric view of a plug connector constructed in accordance with one embodiment of the present invention, and showing the front end of a stripped coaxial cable that is connectable to a rear end of the plug connector.

FIG. 2 is an isometric view of a connector device that is mateable to the connector of FIG. 1, and also showing a portion of a circuit board to which the termination end of the connector device can be attached.

FIG. 13 is a sectional view taken on line 13—13 of FIG. 3.

FIG. 14 is a sectional view taken on line 14—14 of FIG. 3.

FIG. 15 is a sectional view taken on line 15—15 of FIG. 3.

FIG. 16 is a schematic diagram showing an analogy between the sectors of FIG. 13 and a group of four resistors connected in parallel.

DESCRIPTION OF THE PREFERRED EMBODIMENTS

Figure 4:
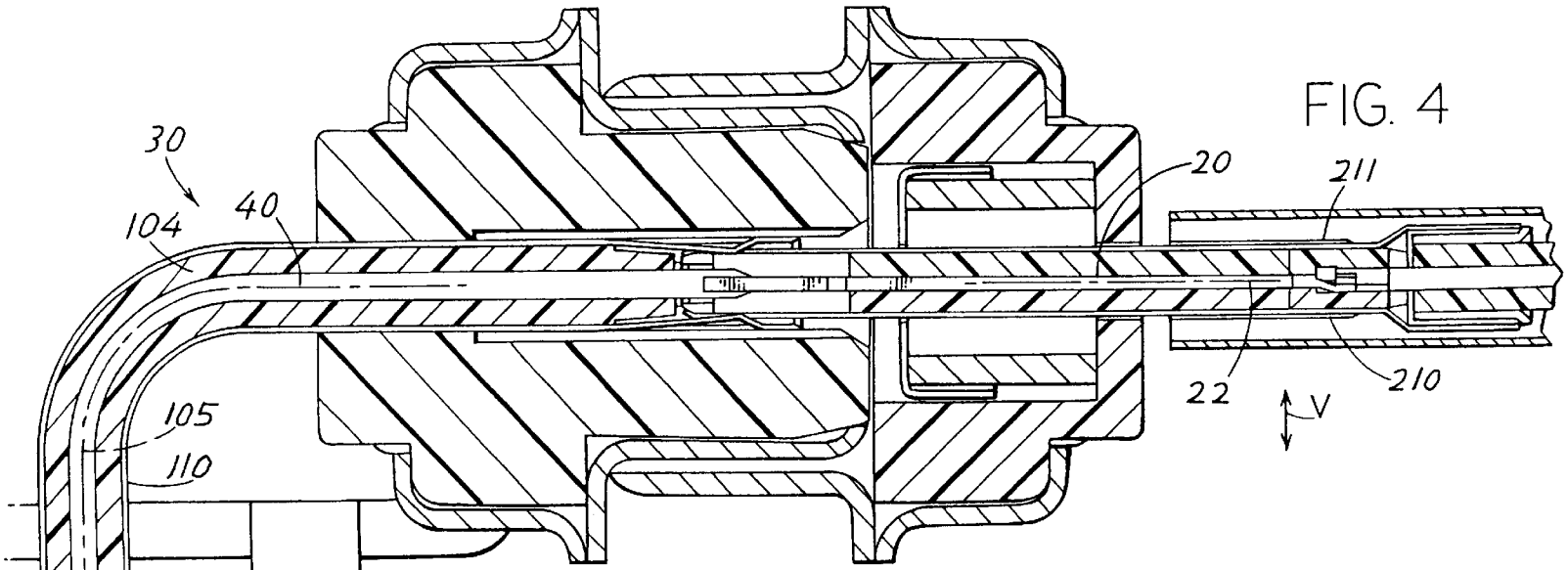
FIG. 4 is a sectional view taken on line 4—4 of FIG. 3.

FIG. 1 illustrates a coaxial-type contact assembly, or connector 10 which is used to connect a coaxial cable 12 carrying high frequency signals (commonly in the megahertz and gigahertz range). Front and rear directions are indicated by arrows F, R, up and down directions by arrows U, D, and lateral directions by arrows L. The connector is a plug type, which has a front mating end 14 for mating with a receptacle coax-like connector, and which has a rear termination end 16 for connection to the coaxial cable. The connector includes an inner contact 20 extending along an axis 22 of the connector, an outer contact 24 (that is usually grounded) surrounding the inner contact, and an insulation 26 lying between the contacts. FIG. 2 illustrates a coaxial-like receptacle contact assembly, or second connector device 30, which has a rear mating end 32 that mates with the front mating end of the plug connector of FIG. 1. The second connector has a front termination end 34 that is terminated to traces on a circuit board 36. This is accomplished by plugging an inner contact device 40 into a plated hole 42 in the circuit board, and plugging projections 44, 46 of the outer contact 50 into plated holes 52 in the circuit board.

It can be seen that there are several discontinuities in the connectors of FIGS. 1 and 2, which ordinarily would result in changes in impedance resulting in reflections of signals and consequent losses. For example, the plug connector 10 of FIG. 1 has a cutout 60 in the insulator that receives a tab 62 of the outer conductor to hold them in place. Also, the outer conductor has tines 64 for retention of the contact in a connector assembly housing. As shown in FIG. 2, the receptacle connector has an outer contact 50 with a cutaway at 66 to prevent the outer contact from touching a circuit board trace 70 that extends from the plated hole 42, as well as having the discontinuities described for the plug-type connector. All of these disruptions could potentially result in losses, but applicant's construction minimizes losses resulting from such disruptions.

Figure 3:
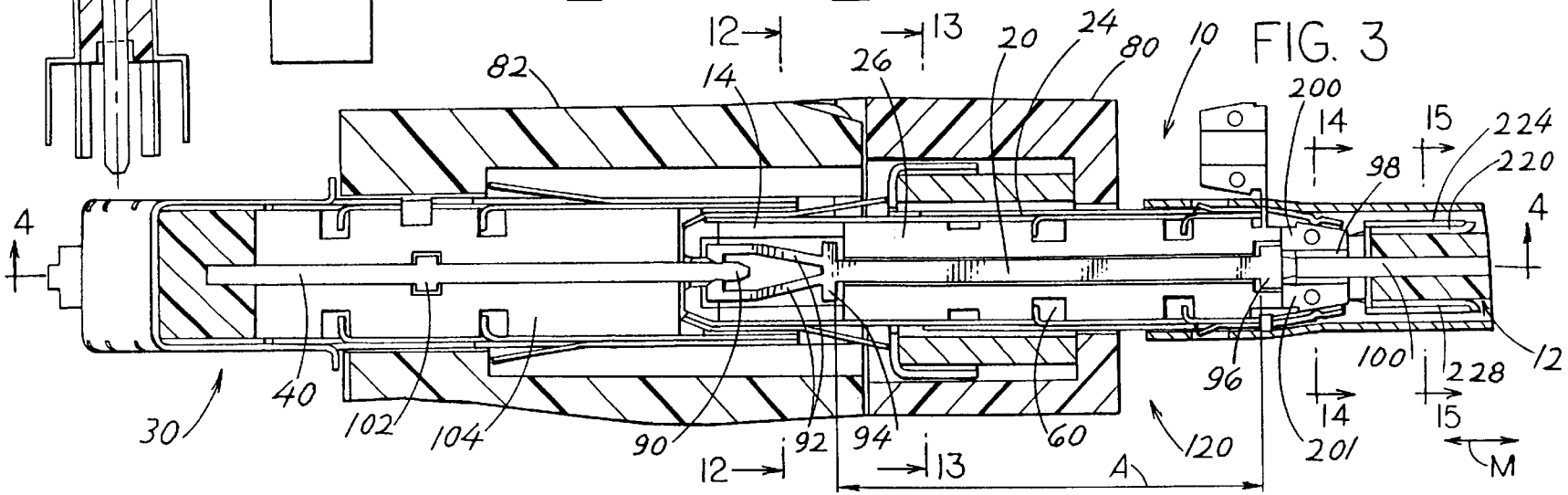
FIG. 3 is a sectional view taken on line 3—3 of the plug connector of FIG. 1, with the connector device of FIG. 2 fully mated therewith, and also showing a portion of a surrounding connector assembly.

FIGS. 3 and 4 show the plug and receptacle contact assemblies 10, 30 fully mated and lying in connector assembly housings 80, 82. Each housing may hold more than one coaxial-type contact assembly, and may also hold lower frequency contacts for power and low frequency signals. The inner contact device 40 of the receptacle connector has a mating end 90 that is inserted between a pair of resilient arms 92 at the mating end of the plug connector 10. The inner contact 20 of the plug contact assembly has a pair of enlargements 94, 96 forming retention parts that prevent forward and rearward longitudinal M movement of the inner contact within the insulation 26. The rear end 98 of the inner contact is shown crimped around the center conductor 100 of the coaxial cable 12. The second inner contact or contact device 40 has an enlargement 102 that retains it within an insulation device 104 whose axis 105 is curved.

It may be noted that in FIG. 3, the inner contact 20 and inner contact device 40 have various locations of increased width, primarily for retention and mating functions. However, in a sectional view shown in FIG. 4, there are fewer changes in height of the inner contact 20 and inner contact device 40. This is done because applicant maintains a primarily constant characteristic impedance along the height V (which turns 90° at the bent end 110 of the receptacle connector 30), while allowing considerable variations in the horizontal directions.

The inner contact 20 of FIG. 3 is of substantially constant cross-section along a major region 120 (not necessarily continuous) of a length A which is at least one third and preferably at least one-half, the length of the inner contact. A sectional view taken at 13—13 in FIG. 3 along this major region is shown in FIG. 13. It can be seen that the inner contact 20 has a width K in a horizontal lateral direction L that is much larger than its thickness or height J in a vertical direction V. Also, it can be seen that the outer contact 24 has a lateral width E that is much greater than its vertical height H. It is noted that only the external surfaces of the inner contact and the inner surfaces of the outer contact are relevant here. As a result of these differences, the lateral distance C between each side 130 of the inner contact and the corresponding inner side surface 132, 134 of the outer contact is much greater than the distance G between the top or bottom surface 135 of the inner contact and the corresponding inner upper or lower surface 136, 138 of the outer contact. This results in a much lower characteristic impedance at first or primary sectors 140, 142 that subtend angles N of 90° around the axis 22 than the impedance at secondary sectors 144, 146 that each subtend an angle P of 90°. Actually, between lines 147 and 148 that each extends at 45° from the upward direction, the distance between the inner and outer contacts is between 100% and about 140% of G (1/sin 45°=141%, so one primary sector may be said to lie between lines 147, 148. It is noted that along the main region such as shown in FIG. 13, the contacts are symmetric about a vertical center line 150 and are symmetric about a horizontal center line 152.

The much lower impedance at the primary sectors 140, 142 makes them dominant in determining the characteristic impedance substantially anywhere along the longitudinal length of the connector. Since the secondary sectors 144, 146 have much higher impedances than the primary sectors, variations in impedance along the secondary sectors does not have anywhere as large an effect on the characteristic impedance at any location along the length of the connectors, as would changes in the characteristic impedance along the primary sectors. There is a variation of at least 20% in the impedance along the secondary sectors, along the length of the inner contact, but less than half that variation along the primary sectors.

FIG. 16 shows four resistors 140R, 142R, 144R, and 146R connected in parallel to provide an analogy to high frequency current passing through the four sectors 140–146 of the cross-section of FIG. 13. In FIG. 16, the primary resistors 140R and 142R are of low resistance, so most of the current 158 that passes through the four parallel-connected resistors passes along paths 160, 162 through the lowest resistances 140R, 142R. Only small amounts of current 164, 166 pass through the high resistances 144R, 146R. As a result, moderate changes in the large resistances 144R, 146R have little effect on the total resistence encountered by the current 158. It should be noted that this analogy represents the qualitative effect but not the quantitative effect for characteristic impedances through sectors of a coaxial contact assembly.

In FIG. 13, the large width K of the top and bottom faces of the inner contact and the corresponding top and bottom surfaces 136, 138 of the outer contact, and their small spacing G, results in a low impedance at the primary sectors 140, 142, such as about 50 ohms. Such low impedance should extend around at least 120°, with the primary sectors 140, 142 actually shown extending by 180°. The much smaller sides of length J of the inner contact face the sides 132, 134 of the outer contact, and the much greater separation C results in a much greater impedance such as 75 ohms at each of the secondary sectors 144, 146. As a result, a much greater percent of the signals carried by the connector, passes along the primary sectors than along the secondary sectors and moderate variations in impedance at the secondary sectors does not greatly change the characteristic impedance or cause reflections of signal and consequent losses.

Figure 5:
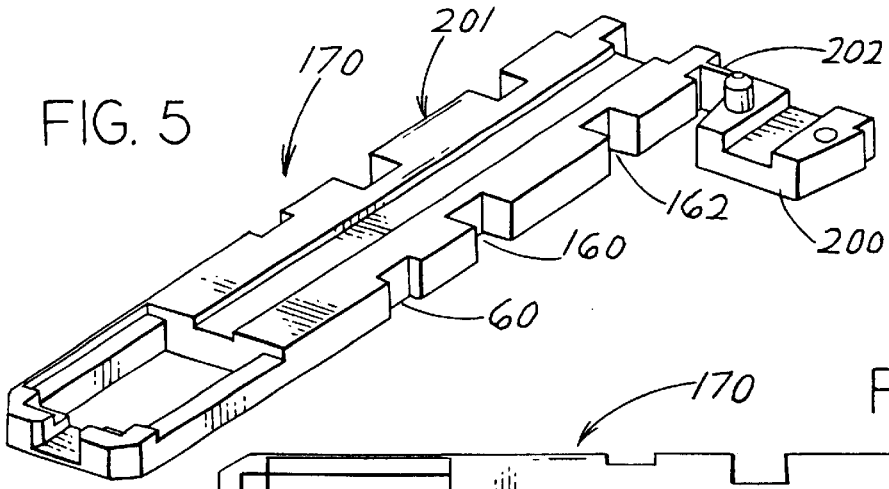
FIG. 5 is an isometric view of an insulation member of the connector of FIG. 1, with the joint-surrounding part lying in its initial position.

As shown in FIG. 5, applicant provides cutouts 60, 160, 162 in the insulation, with each pair of cutouts lying at opposite sides of the connector, occupying at least 20% of cross-sectional area of the insulation. Cutouts 60, 160 are shown in FIG. 13. The cutouts in the solid insulation results in air filling the cutouts. Since air has a lower dielectric constant than the solid material of the insulation, the air increases the impedance at the secondary sectors 144, 146. However, such increases in impedance along the secondary sectors, which already have a high characteristic impedance, do not result in a great overall increase in impedance at that section of the insulation. FIG. 13 shows the cutouts extending primarily into the opposite sides 164, 165 of the insulation but only slightly into the top and bottom 166, 167 of the insulation.

It may be noted that applicant prefers to use a TEFLON type insulation which has a dielectric constant of 2.55 (the impedance of air is 1.0). It may be noted that the impedance of a coaxial connector with only cylindrical surfaces is generally given by the following formula:

$$Z = \frac{138}{\sqrt{e}} \mathrm{Log} \frac{D}{d}$$

where e is the dielectric constant of the material lying between the inner and outer contacts, d is the outside diameter of the inner contact, D is the inside diameter of the outer contact.

Figure 12:
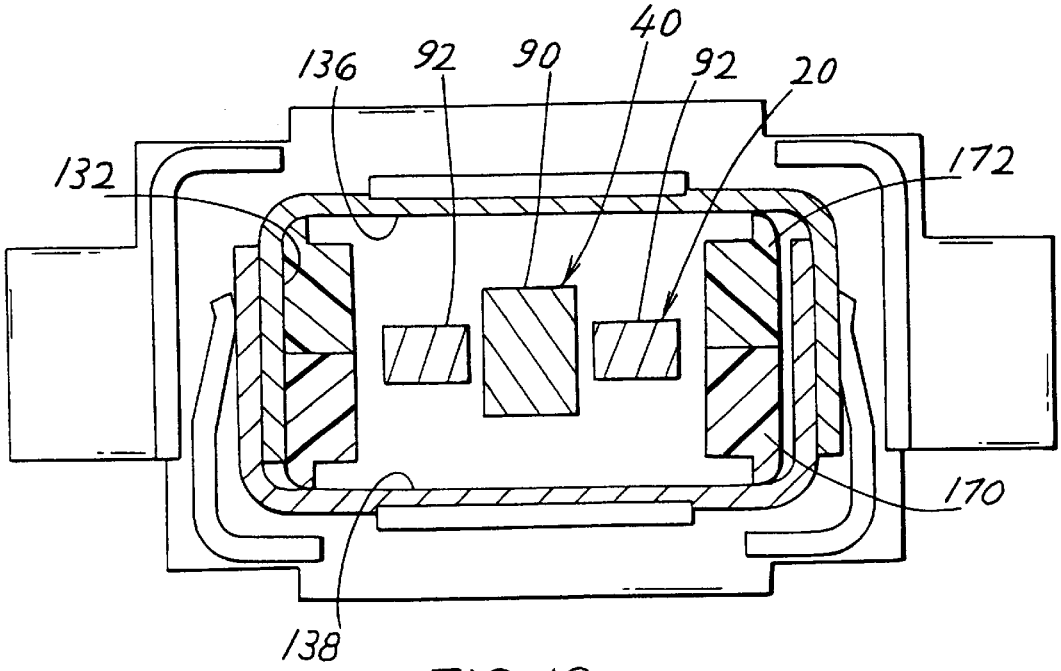
FIG. 12 is a sectional view taken on line 12—12 of FIG. 3.

FIG. 12 shows a cross-section at the mating end of the contact assembly, showing the two arms 92 of the contact 20 and the mating end 90 of the inner contact device 40 of the mating contact assembly device. At the mating end, the arms 92 lie closer to the side surfaces such as 132 of the outer contact, resulting in a reduced impedance in the secondary sectors, and resulting in a decrease in characteristic impedance and consequent reflections. However, since the characteristic impedance at the secondary sectors decrease to only about the level of the primary sectors, the overall impedance decreases only moderately resulting in only moderate reflections and only moderate consequent losses. The impedance at the primary sectors decreases due to air. However, the two arms 92, with twice the area facing the upper and lower outer contact surfaces 136, 138, results in only a moderate change. It is noted that the losses resulting from a change in impedance depend upon the amount of the change and the length of the region where the change occurs.

Figure 10:
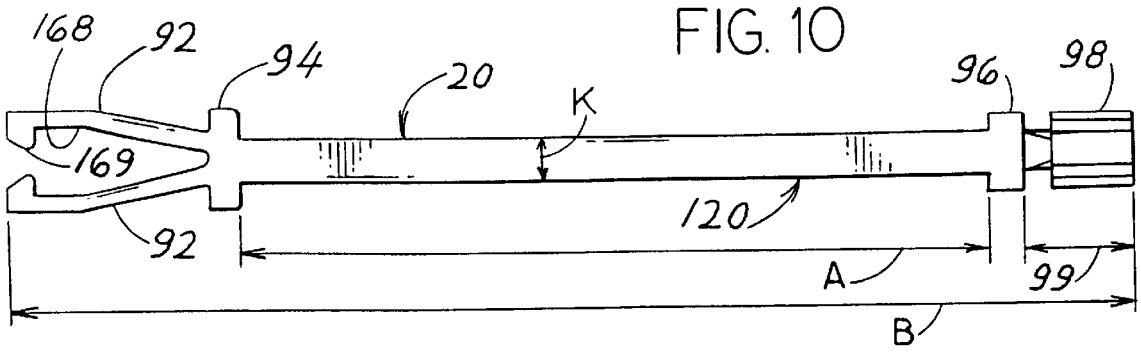
FIG. 10 is a plan view of the inner contact of the connector of FIG. 1.
Figure 11:
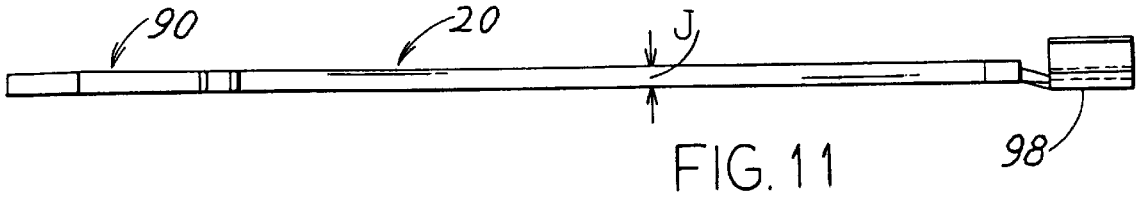
FIG. 11 is a side elevation view of the inner contact of FIG. 10.

FIGS. 10 and 11 show that the arms 92 at the mating end of the inner contact have middle arm locations 168 that are widely spaced, and front arm locations 169 that are spaced apart by a smaller distance. However, there is substantially no change in inner contact thickness there.

The coaxial-type connector can be constructed of easily manufactured parts, with the inner contact 20 shown in FIGS. 10 and 11 formed of sheet metal punched or blanked from a larger sheet of metal. It can be seen in FIG. 11 that the inner contact 20 has a uniform thickness J along the major region 120 of length A, with the mating end 90 also having the same thickness. The rear termination end 98 has a reduced thickness formed by compressing the rear end, which will be discussed below. The enlargements 94, 96 and arms 92 can be easily formed when punching the inner contact from a piece of sheet metal. This avoids the expense of machining a cylindrical inner contact from a piece of metal.

Figure 7:
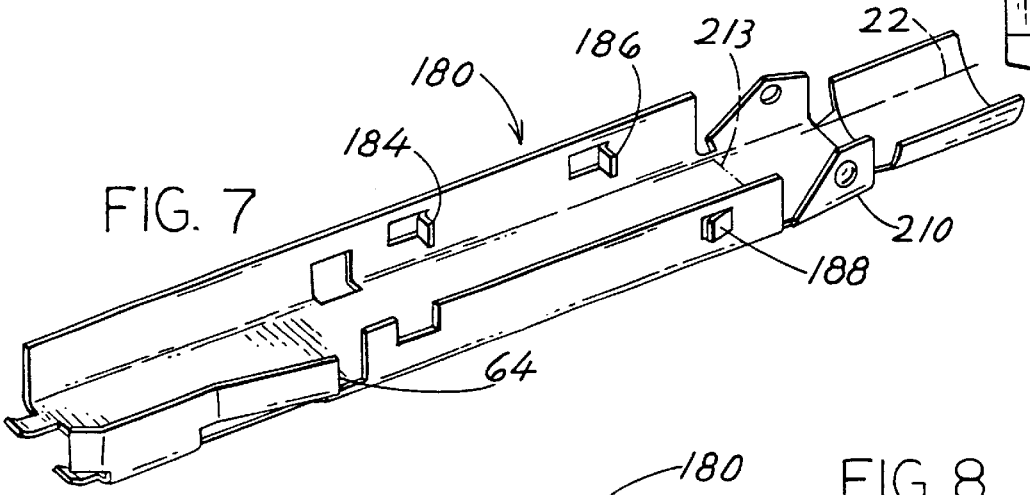
FIG. 7 is an isometric view of an outer contact member of the connector of FIG. 1.
Figure 8:
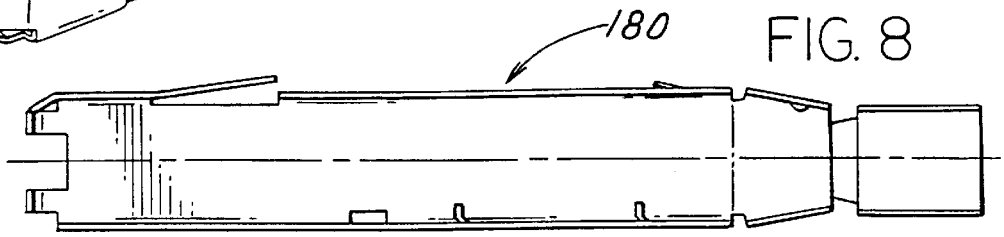
FIG. 8 is a plan view of the outer contact member of FIG. 7.

The contact assembly is constructed with two insulation members 170, 172 (FIG. 13) which are of substantially identical shapes so they can be molded in the same molds and interchanged. The inner contact lies in a passage 174 formed between the insulator members. The outer contact is formed from two substantially identical outer contact members 180, 182 that are interchangeable. The outer contact members are placed in the positions shown in FIG. 13 and locked to one another at least partially by way of the cutouts in the insulation and tabs 184, 186, 188 (FIG. 7).

Applicant constructs the coax-type contact assembly 10 (FIG. 1) so it can be assembled at the factory that makes the parts, and so the customer who purchases a connector assembly can terminate it to a coax cable 12 without disassembling the parts of the contact assembly. Of course, this avoids the need for multiple loose parts that must be properly assembled. FIGS. 10 and 11 show that the inner contact rear terminal end 98 is bent to the shape of a half cylinder. The center conductor of a coaxial cable can be laid in the termination end 98 and can be crimped in place by crimping the end around it. A solder connection could be made. In prior coax contact assemblies the inner contact had to be slid to a position at least partially rearward of the rest of the connector assembly while it was terminated to the cable center conductor, and only then could the inner contact be inserted forward into the insulation of the contact assembly.

Figure 6:
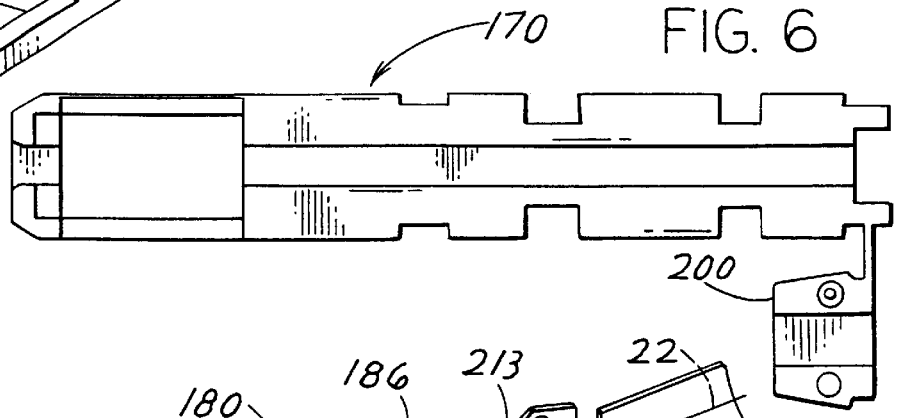
FIG. 6 is a plan view of the insulation member of FIG. 5.
Figure 9:
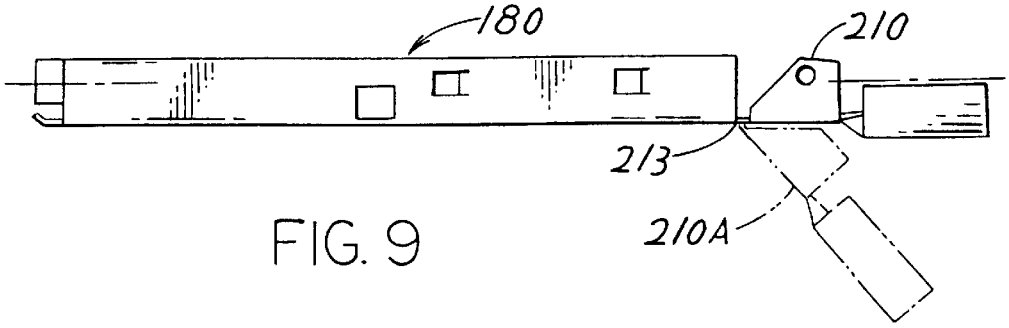
FIG. 9 is a side elevation view of the outer contact member of FIG. 7, and showing,in phantom lines, the rear termination portion in its deflected position.

Applicant provides room around the termination end 98 during crimping (or soldering) by forming each insulator member, shown in FIG. 5, with a joint-surrounding part 200 that can be moved with respect to the major portion 201 of the insulation member, and that is preferably connected by a string or strap 202 to the rest of the insulation member. The insulation member 170 is preferably molded with the strap 202 and the part 200 being molded integrally with the rest of the member. In the initial position shown in FIGS. 5 and 6, the part 200 is away from the central area where the cable is terminated to the contact. In addition, applicant constructs each outer contact member 180 in FIG. 7, with a rear termination portion 210 that can be bent about a line 213 away from the axis 22 to a deflected position shown at 210A in FIG. 9. With the outer contact rear termination portions bent up and down and the insulation member joint-surrounding portions 200 lying to the side of the crimp or solder joint, there is room around the joint to complete the joint. After the joint is completed, the joint-surrounding parts 200 of the insulation member are pivoted to their final positions shown at 200 in FIG. 14 to closely surround the crimped rear termination end 98A of the inner contact and the compressed cable center conductor 100A. It is noted that the joint-surrounding insulation parts 200 have holes 212 and posts 214 to properly align them around the rear termination end of the inner contact. Then rear termination portions 210, 211 of the outer contact are bent back to positions that closely surround the joint-surrounding parts of the insulation.

FIG. 15 shows a pair of shell halves 220 surrounding the jacket 222 of the cable. An outer crimp ferrule 224 is crimped around the shell halves 220 and around a braiding 230 of the cable.

In a contact assembly of the construction illustrated in FIG. 13 that applicant has designed, the inner contact 20 had a thickness J of 11.3 mils (one mil equals one thousandth inch) and a width K of 22.8 mils. It is preferred that the width K be at least 140% of the height J. The inner surfaces of the outer contact 24 were spaced by a width E of 94 mils and a height H of 54 mils. The vertical distance G between the inner and outer contacts was 21 mils while the horizontal distance C between the inner and outer contacts was 37 mils. Thus, C was 171 percent of G. Applicant prefers that the ratio C/G be at least 140 percent, preferably at least 155 percent, and more preferably at least 165 percent, so moderate variations in impedance in the secondary sectors 144, 146 create only small changes in the overall impedance at the corresponding cross-section of the contact assembly. The major region, shown in FIG. 10, had a length A of 410 mils, and the overall length B of the inner contact was 623 mils. Excluding the rear termination end 98 of length 99 of 65 mils, the contact overall length (B-98) was 558 mils. The ratio A/B is 66%, or about two-thirds, while the ratio AN(B-98) is 73%.

Figure 17:
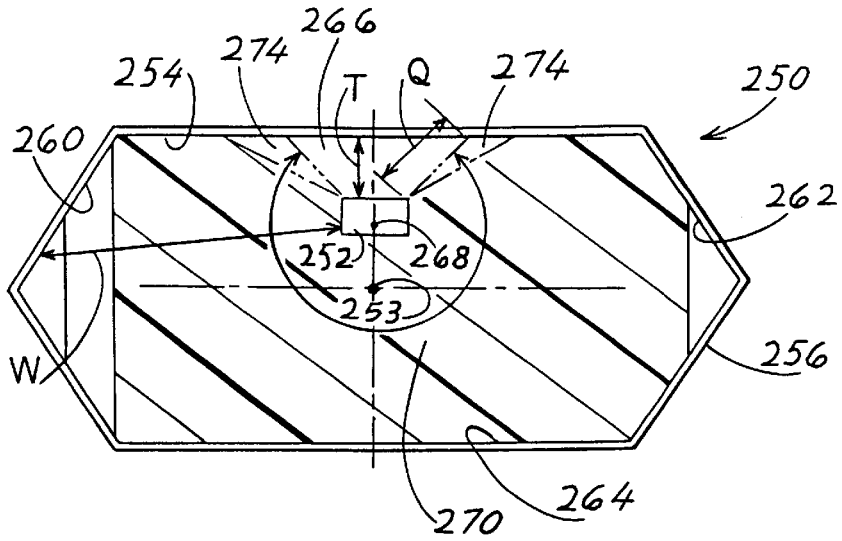
FIG. 17 is a sectional view of a connector of another embodiment of the invention which is of somewhat rectangular cross-section but with a vertically offset center conductor.

FIG. 17 illustrates the cross-section along a major region of a coaxial type contact assembly 250 of a different shape, which is not preferred but which helps show the principles of the invention. In this assembly the inner contact 252 is above the axis 253 so it is much closer to a top surface 254 of the outer contact 256 than to opposite side surfaces 260, 262 or a bottom surface 264. In this case, there is a major sector indicated at 266 of about 90° about point 268, where the impedance is lowest, with a minor sector 270 extending by an angle of about 200° about point 268 where the impedance is much higher. The point 268 is chosen as the point where lines 276, 278 meet, where lines 276, 278 extend at 450 from the vertical through an end of the top surface of the inner contact. The distance Q at the edges of the ends of the main sector is about 140% of the minimum distance T. Changes in impedance along the length of the assembly have little impact if they occur along the secondary sector 270, so cutouts, metal tabs, etc. are preferably placed in the secondary sector. Significant impedance changes in the primary sector result in significant losses, while significant impedance changes in intermediate sectors 272, 274 result in moderate losses. The distance W in the minor sector is more than 140% (actually more than 165%) of the minimum distance T in the major sector.

Figure 18:
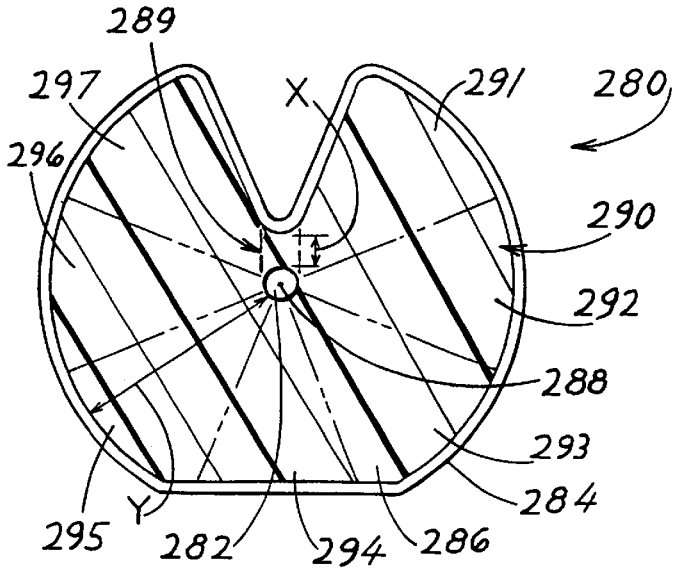
FIG. 18 is a sectional view of a connector of another embodiment of the invention, where the primary sector is narrow.
Figure 19:
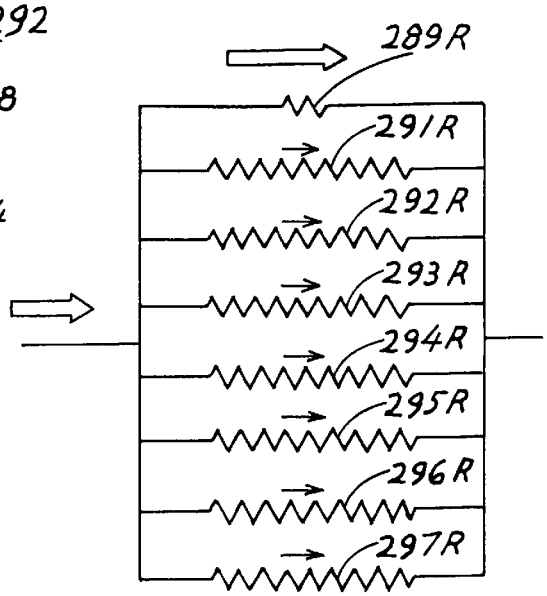
FIG. 19 is a schematic diagram for the sectors of the connector of FIG. 18.

FIG. 18 illustrates the cross-section along a major region of a coaxial type contact assembly 280 of a different shape, which is not preferred but which is instructive. The assembly includes inner and outer contacts 282, 284, a solid insulator 286, and an axis 288. The shape results in a major sector at 289 and a minor sector 290 extending around the rest of the inner contact. The distance Y in the minor sector is more than 165% of the distance X in the major sector. The minor sector can be considered to form seven minor sectors 291–297. FIG. 19 shows an analogy between the impedances of the eight sectors 289 and 291–297 and the resistances of eight resistors 289R and 291R–297R connected in parallel, with a low resistance 289R and with much higher resistance 291R–297R. A moderate change in primary resistance 289R has a considerable effect on the net resistance of the parallel connection, but the same percent change in any one of the secondary resistances has a negligible effect.

While terms such as "upper", "lower", "horizontal" and "vertical" have been used to help describe the invention as illustrated, it should be understood that the coaxial-type contact assembly can be used in any orientation with respect to the Earth.

Thus, the invention provides a coaxial-type connector, or contact assembly, which can be constructed at low cost, which can be provided with cutouts in the insulation for receiving retention features and with lateral enlargements in the inner contact for retention and mating features without significant increases in losses, and which enables termination of a cable inner conductor to the inner contact without removing it and without the presence of many loose pieces. The connector includes an inner contact with an axis, an outer contact that extends an average of at least 80% around the axis, and an insulation between them. Along a major region of the inner contact that extends by at least one third and preferably at least one half of the length of the inner contact, the distance between the inner and outer contacts is at least 140% greater at secondary sector(s) where there are large impedance changes, than at primary sector(s) where a relatively constant impedance is maintained. The ratio of distances is preferably at least 140%, more preferably at least 155%, and most preferably at least 165%. For a connector of rectangular cross-section with the inner contact centered, the distance between the inner contact and each side surface of the outer contact is at least 140 percent of the distance between the inner contact and the upper and lower surfaces of the outer contact. This allows for cutouts in the sides of the insulation where solid insulation is replaced by air and into which sheet metal tabs of the outer contact may project. This construction also facilitates construction of the inner contact of sheet metal, with the inner contact preferably having a width that is at least 140 percent of its height, and with the sheet metal forming a pair of socket arms at the mating end of the inner contact. At the rear termination end of the contact assembly, the sheet metal outer contact is preferably moveable out of the way. Also, the insulation has a pair of joint-surrounding parts that are moveable out of the way so termination can take place without removing the inner contact. After the joint is formed, the joint-surrounding insulation parts can be moved closely around the joint where the inner contact connects to the cable center conductor and the sheet metal then being closeable around all of it. The insulation preferably includes two identical insulation members with joint-surrounding parts connected by a bendable strap to the rest of the insulation member to avoid loose parts.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial type contact assembly having a front mating end and a rear termination end, said contact assembly including a single inner contact having a length extending along an axis, an outer contact surrounding the inner contact, and an insulation between said contacts, said inner contact having upper and lower surfaces an opposite side surfaces, wherein:

at locations along a major region that extends along said axis by at least one-third of the length of said inner contact, said outer contact has inside upper and lower surfaces and opposite inside side surfaces that cover a majority of corresponding surfaces of said inner contact, with the distance between said inner contact and each of said outer contact side surfaces being at least 155% of the distance between said inner contact and said outer contact upper and lower surfaces.

2. The contact assembly described in claim 1 wherein:

said inner contact is formed of a piece of sheet metal of constant thickness in a vertical direction, along its length along said mating end and from there to a front of said rear termination end, and with a width in a horizontal direction that is at least 140° of said thickness.

3. The contact assembly described in claim 1 wherein:

said insulation has upper and lower surfaces and opposite side surfaces, and said insulation has a plurality of cutouts in said side surfaces that extend along most of the height of each side surface along said region, but said upper and lower surfaces are devoid of a plurality of cutouts that extends along most of the width of said upper and lower surfaces along said region.

4. The contact assembly described in claim 1 wherein:

said inner contact is formed of a piece of sheet metal with said inner contact thickness being the thickness of the sheet metal, and said inner contact has a front mating end at said contact assembly mating end;

at said inner contact mating end said piece of sheet metal has an increased width and forms a pair of arms with middle arm locations that are spaced apart in said width direction and with front arm locations that are spaced apart by a smaller distance to receive a mating inner contact device between said arms, but with the thickness of said inner contact being substantially constant at said inner contact mating end.

5. The contact assembly described in claim 1, wherein:

the distance between said inner contact and each of said side surfaces is at least 155% of the distance between said inner contact and said upper surface.

6. The contact assembly described in claim 1 wherein:

in sectional views taken along said region, said connector has a plurality of sectors that subtend an angle of 360° around said axis, where the impedance at a first group of sectors is at least 10% lower than the impedance at a second group of different sectors that subtend a total of at least 120°, and with the impedance along said second group of sectors varying by at least 20% along said region but with the impedance along said first group of sectors varying by less than half the variation of said second group.

7. The contact assembly described in claim 6 wherein:

said insulator comprises primarily a solid material, but with cutouts in said solid material at at least one of said locations to leave air in at least part of the space between said inner and outer contacts thereat, with said cutouts occupying at least 20% of the insulation as seen in a sectional view taken normal to said axis, but with said cutouts lying in said second group of sectors but substantially not in said first group of sectors.

8. The contact assembly described in claim 1 wherein:

said inner contact is elongated in a longitudinal direction that is parallel to front and rear directions, said inner contact has front and rear enlargements spaced apart by a first distance, and said insulation has shoulders spaced by said first distance to engage said enlargements, with said enlargements extending toward said sides of said outer contact but substantially not toward said top and bottom of said outer contact.

9. The contact assembly described in claim 8 wherein:

said insulation includes substantially identical upper and lower insulation members that each forms half of a passage extending along said axis and half of each of said shoulders.

10. A coaxial type contact assembly having a front mating end and a rear cable termination end, said contact assembly having inner and outer contacts and an insulation between them, wherein:

said inner contact has a length along an axis and has a region that extends along at least one half said length, with said inner contact being of substantially rectangular shape along said region with a thickness and with a width that is greater than said thickness;

said outer contact has an inside surface of substantially rectangular cross-section along said region with vertically spaced and substantially horizontal upper and lower inside surfaces and with horizontally spaced inside side surfaces, with the distance between each side surface and said inner contact being at least 155% of the distance between each horizontal surface and said inner contact.

11. The contact assembly described in claim 10 wherein:

said insulation has a pair of shoulders spaced by the length of said region;

said inner contact is formed of a piece of sheet metal with said inner contact thickness being the thickness of the sheet metal, and with said inner contact having a pair of enlargements in its width that are spaced by the length of said region and that lie adjacent to said insulation shoulders to prevent forward and rearward movement of the inner contact, with said enlargements being enlargements in the width of said inner contact but substantially not in the thickness of said inner contact.

12. The contact assembly described in claim 10 wherein:

said inner contact is formed of a piece of sheet metal with said inner contact thickness being the thickness of the sheet metal, and said inner contact has a front mating end at said connector mating end;

at said inner contact mating end said piece of sheet metal has an increased width and forms a pair of arms with middle arm locations that are spaced apart in said width direction and with front arm locations that are spaced apart by a small distance to receive a mating inner contact device between said arms.

13. A coaxial type contact assembly having a single inner contact that has an axis, an outer contact that surrounds the inner contact, and an insulation lying in the space between them, wherein:

said inner contact has a location that is closest to said outer contact at at least one primary sector of said space and said inner contact has a location that is furthest from said outer contact at at least one secondary sector of said space, said outer contact covers a majority of all of said sectors along the length of said inner contact, where said primary and secondary sectors each has a radial length that extends between said inner and outer contacts, with said secondary sector occupying at least 120% about said axis along at least one-third of the length of said inner contact along said axis, with the distance between said conductors being at least 155% as great at said secondary sector than at said primary sector.

14. A coaxial type contact assembly having an axis, a front mating end and a rear termination end for termination to a coaxial cable, said contact assembly including an inner contact having a length extending along said axis, an outer contact, and an insulation between said contacts, wherein:

said insulation has a main portion that forms a passage with said inner contact lying in said passage, and said insulation has a rear portion with at least one joint-surrounding part;

said outer contact includes upper and lower sheet metal parts with main portions and with rear portions, with at least one of said rear portions being bendable away from alignment with one of said main portions to a deflected position to provide access to a rear termination end of said inner contact, and being bendable to a final position substantially in alignment with said one of said main portions and around said joint-surrounding parts;

said at least one joint-surrounding part being pivotable between an initial position away from a location rearward of said insulation main portion, and a final position where said joint-surrounding part lies directly rearward of said insulation main portion.

15. The contact assembly described in claim 14 wherein:

said at least one joint-surrounding part includes a strap that connects to said insulation main portion, with said strap being bendable to allow said joint-surrounding part to move between said initial and final positions of said joint-surrounding part.

16. The contact assembly described in claim 14 wherein:

said insulation includes substantially identical upper and lower insulator members that each forms part of an inner contact-holding cavity that directly engages said inner contact and one joint-surrounding part and an integral bendable strap that joins the joint-surrounding part to the corresponding insulator member.

17. A method for terminating a center conductor of a coaxial cable to a termination end of an inner contact of a coaxial-type contact assembly, where the assembly includes an insulation with a joint-surrounding insulation portion lying around the inner contact termination end and an outer contact with surrounding parts that lie around said joint-surrounding insulation portion, comprising:

establishing said outer contact surrounding parts away from a final position of said joint surrounding insulation portion, and establishing said joint-surrounding insulation portion away from said termination end of said inner contact;

joining said center conductor to said termination end of said inner contact to form a joint;

pivoting said joint-surrounding insulation portion around said joint, and moving said outer contact surrounding parts closely around said joint-surrounding insulation portion.

18. The method described in claim 17 wherein:

said joint-surrounding insulation has two insulation parts that each engages said inner contact, said step of establishing said joint-surrounding insulation portion includes establishing said insulation parts on opposite sides of said joint;

said steps of moving include moving said insulation parts laterally together around said joint, and moving said outer contact parts vertically together around said insulation portion.

19. A coaxial type contact assembly having a front mating end and a rear termination end, said contact assembly including an inner contact having a length extending along an axis, an outer contact surrounding the inner contact, and an insulation between said contacts, wherein:

at locations along a major region that extends along said axis by at least one-third of the length of said inner contact, said outer contact has inside upper and lower surfaces and opposite inside side surfaces, with the distance between said inner contact and each of said side surfaces being at least 140% of the distance between said inner contact and said upper surface;

said inner contact is elongated in a longitudinal direction that is parallel to front and rear directions, said inner contact has front and rear enlargements spaced apart by a first distance, and said insulation has shoulders spaced by said first distance to engage said enlargements, with said enlargements extending toward said sides of said outer contact but substantially not toward said top and bottom of said outer contact.

20. The contact assembly described in claim 19 wherein:

said insulation includes substantially identical upper and lower insulation members that each forms half of a passage extending along said axis and half of each of said shoulders.

21. A coaxial type contact assembly having a front mating end and a rear termination end, said contact assembly including an inner contact having a length extending along an axis, an outer contact surrounding the inner contact and an insulation between said contacts, wherein:

at locations along a major region that extends along said axis by at least one-third of the length of said inner contact, said outer contact has inside upper and lower surfaces and opposite inside side surfaces, with the distance between said inner contact and each of said side surfaces being at least 140% of the distance between said inner contact and said upper surface;

said insulation has upper and lower surfaces and opposite side surfaces, and said insulation has a plurality of cutouts in said side surfaces that extend along most of the height of each side surface along said region, but said upper and lower surfaces are devoid of a plurality of cutouts that extends along most of the width of said upper and lower surfaces along said region.

22. A coaxial type contact assembly having a front mating end and a rear termination end, said contact assembly including an inner contact having a length extending along an axis, an outer contact surrounding the inner contact, and an insulation between said contacts, wherein:

at locations along a major region that extends along said axis by at least one-third of the length of said inner contact, said outer contact has inside upper and lower surfaces and opposite inside side surfaces, with the distance between said inner contact and each of said side surfaces being at least 140% of the distance between said inner contact and said upper surface;

said inner contact is formed of a piece of sheet metal with said inner contact thickness being the thickness of the sheet metal, and said inner contact has a front mating end at said contact assembly mating end;

at said inner contact mating end said piece of sheet metal has an increased width and forms a pair of arms with middle arm locations that are spaced apart in said width direction and with front arm locations that are spaced apart by a smaller distance to receive a mating inner contact device between said arms, but with the thickness of said inner contact being substantially constant at said inner contact mating end.

* * * * *

UNITED STATES PATENT AND TRADEMARK OFFICE

CERTIFICATE OF CORRECTION

PATENT NO. : 6,406,303 B1 
DATED : June 18, 2002
INVENTOR(S) : Michael Lawrence Kosmala It is certified that error appears in the above-identified patent and that said Letters Patent is hereby corrected as shown below:

Column 8,
Lines 61-67, delete claim 2;

Column 9,
Lines 1-22, delete claims 3 and 4;
Lines 46-59, delete claims 8 and 9.

Signed and Sealed this

Twenty-ninth Day of October, 2002

*Attest:*

*Attesting Officer*

JAMES E. ROGAN
*Director of the United States Patent and Trademark Office*